US008375880B1

(12) United States Patent
St. Clair, Jr. et al.

(10) Patent No.: US 8,375,880 B1
(45) Date of Patent: Feb. 19, 2013

(54) RETRACTABLE STEP FOR BOAT SWIM PLATFORM

(75) Inventors: William Paxson St. Clair, Jr., Leawood, KS (US); Timothy W. Kaiser, Independence, KS (US); Bret A. Chilcott, Neodesha, KS (US); Sean P. Callan, Owasso, OK (US)

(73) Assignee: Cobalt Boats, LLC, Neodesha, KS (US)

( * ) Notice: Subject to any disclaimer, the term of this patent is extended or adjusted under 35 U.S.C. 154(b) by 312 days.

(21) Appl. No.: 12/822,564

(22) Filed: Jun. 24, 2010

(51) Int. Cl.
*B63B 17/00* (2006.01)

(52) U.S. Cl. ..... 114/362; 182/84

(58) Field of Classification Search ..... 114/362; 182/84, 88; 14/69.5, 71.1
See application file for complete search history.

(56) References Cited

U.S. PATENT DOCUMENTS

| | | | | |
|---|---|---|---|---|
| 4,293,967 | A * | 10/1981 | Ord | 114/362 |
| 4,462,485 | A | 7/1984 | Terry et al. | |
| 4,495,883 | A | 1/1985 | Hoy | |
| 4,669,414 | A | 6/1987 | Molino | |
| 4,765,438 | A | 8/1988 | Ritten | |
| 4,823,910 | A | 4/1989 | Day | |
| D304,573 | S | 11/1989 | Hoszowski | |
| 4,964,358 | A | 10/1990 | Sandrow | |
| 5,025,747 | A | 6/1991 | Grayson | |
| 5,085,164 | A | 2/1992 | Whitton | |
| 5,123,372 | A * | 6/1992 | Kobayashi et al. | 114/362 |
| 5,613,462 | A | 3/1997 | Schwartz | |
| 5,632,224 | A | 5/1997 | Schneider | |
| 5,829,380 | A | 11/1998 | Smith | |
| 6,098,566 | A | 8/2000 | Metcalf | |
| 6,119,615 | A | 9/2000 | Porat | |
| 6,904,863 | B2 * | 6/2005 | Mardikian et al. | 114/362 |
| 7,121,226 | B2 * | 10/2006 | Grimaldi | 114/362 |
| 7,162,969 | B2 | 1/2007 | Houlder et al. | |
| 7,182,175 | B1 * | 2/2007 | Schmitt et al. | 182/88 |
| 7,237,503 | B2 | 7/2007 | Stepp | |
| 7,293,521 | B1 | 11/2007 | Johns, Jr. et al. | |
| 7,314,019 | B1 * | 1/2008 | Curi et al. | 114/362 |
| 7,607,400 | B2 * | 10/2009 | Scotti | 114/362 |
| 2005/0016439 | A1 | 1/2005 | Mardikian et al. | |

OTHER PUBLICATIONS

Product Information on "Cobalt Boats A25", downloaded from internet on Feb. 15, 2010 at http://www.cobaltsboats.com/m1210/A25/index.php (1 page).

Product Information on "Cobalt Boats", downloaded from internet on Feb. 15, 2010 at http://www.cobaltboats.com/art/maedi/A2510_A259507L.jpg (1 page).

Product Information on "OPACMARE", downloaded from internet on Feb. 15, 2010 http://www.opacmare.it/pages/English_Home/101 (1 page).

Product Information on "Hydraulic Platform Lift for sailboat and power boats personal watercraft, tenders, makes . . . ", Beaver-Brand Canvas, Inc., downloaded from internet on Feb. 15, 2010 at http://www.beaver-brandcanvas.com/hydraulicplatformli.html (1 page).

(Continued)

*Primary Examiner* — Lars A Olson
(74) *Attorney, Agent, or Firm* — Stinson Morrison Hecker LLP

(57) ABSTRACT

A retractable step for use with a boat in water comprising at least one moveable arm pivotally coupled with the boat, a step coupled with the arm such that the step is moveable between a stored position above the water surface and a deployed position below the water surface, and a lock configured to hold the moveable arm in a stationary position when the step is in its deployed position, but is releasable to accommodate movement of the step to its stored position.

6 Claims, 3 Drawing Sheets

OTHER PUBLICATIONS

Product Information on "Hydraulic Swim Platforms", Florida Bow Thrusters, downloaded from the internet on Feb. 15, 2010 at http://www.floridabowthrusters.com/swim-platforms.html (1 page).

Product Information on "Swim Platforms", Fleet-Hydrol, downloaded from the internet on Feb. 15, 2010 at http://www/fleet-hydrol.com.au/marine/swimplatforms.htm (1page).

* cited by examiner

Fig. 1.
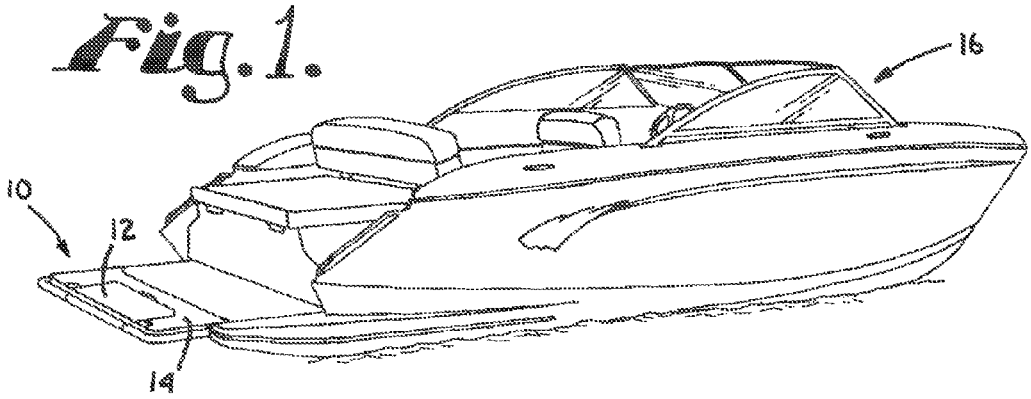
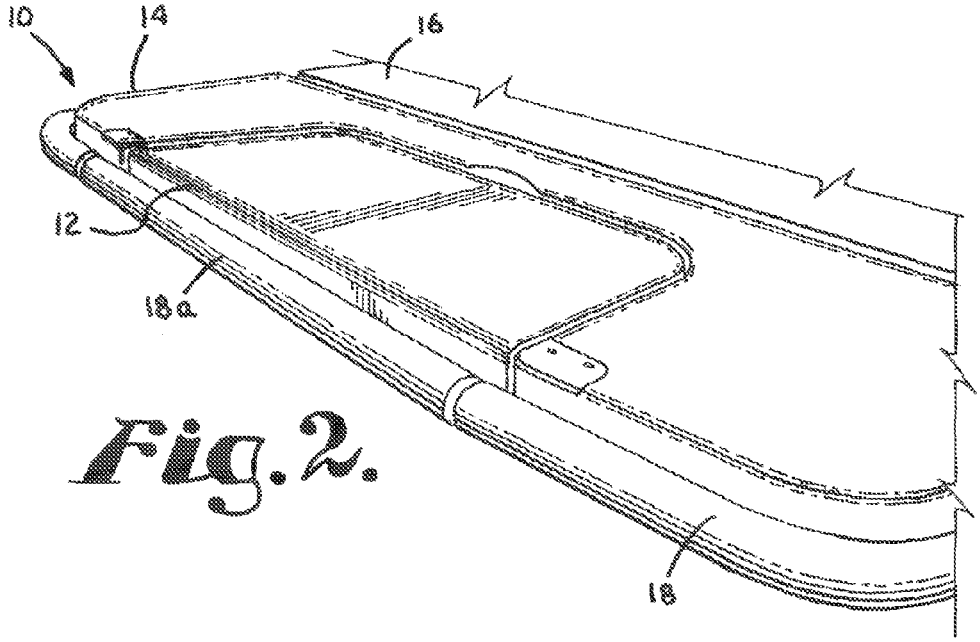
Fig. 2.

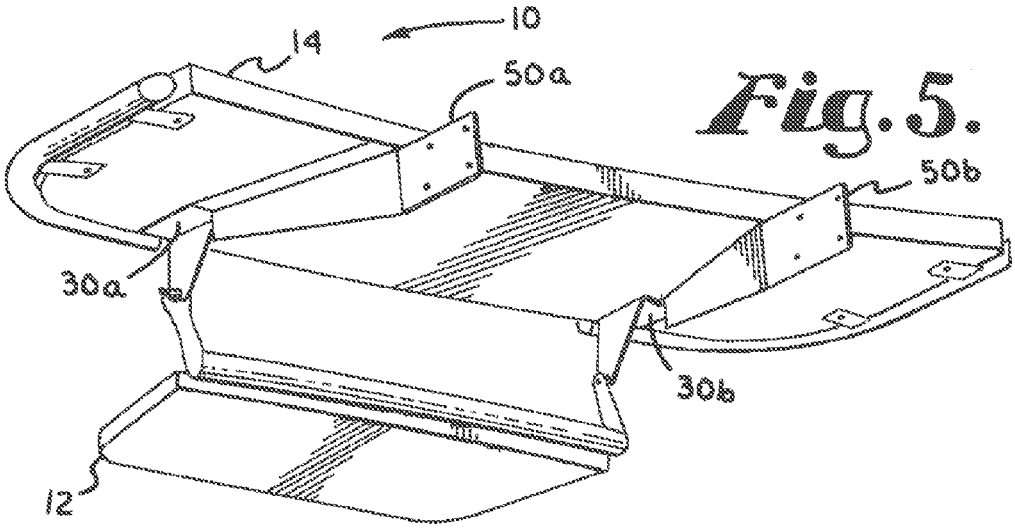
Fig. 5.
Fig. 6.
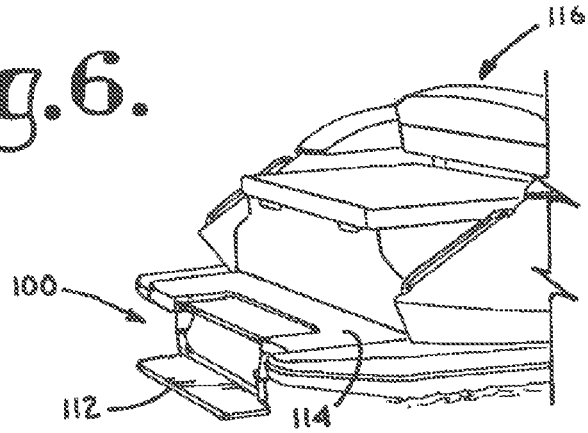

RETRACTABLE STEP FOR BOAT SWIM PLATFORM

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

1. Field of the Invention

The present invention relates to a retractable step for a boat swim platform.

2. Description of Related Art

Recreational boaters enjoy spending time swimming around the back of their boats. Entering and leaving the water from the back of the boat often requires a swim ladder. Swim ladders typically provide a series of multiple, small steps between the boat and the water. Swim ladders known in the art include ladders that can be removed from the boat or collapsed for storage.

In addition to ingress and egress issues, space for standing or sitting on the back of the boat is often limited. To add space to this area of the boat, boat owners often attach swim platforms to the transom of their boats. These swim platforms are generally positioned above the surface of the water and provide a flat, level space on which users may sit or stand while the boat is stationary. Swim platforms also provide a level surface that swimmers may use to assist them in entering or leaving the water.

BRIEF SUMMARY OF THE INVENTION

The retractable step of the present invention is designed for use with a boat. In general, the retractable step comprises a large step that is moveable between a stored position and a deployed position. In the fully deployed position, the step may be locked below the water surface. In this position, swimmers may use the step to reach the swim platform or may rest on the step while at least partially submerged in the water. The step is easily moved from the deployed position to the stored position by releasing the lock and retracting the step into its stored position. Preferably the step is made from a material that floats on the surface of the water. Thus, when the step is unlocked from its deployed position, it floats to the water surface and is readily retrievable by a user desiring to move the step into its stored position. When in the stored position, the step is above the water surface and does not add unwanted length to the boat.

In one embodiment, the step includes a base or swim platform. The swim platform may be integral with the boat or removably attached to the boat. The swim platform preferably includes a recess or other compartment for storing the step, such that when the step is in the stored position the swim platform may be used as a flat, level platform for sitting, standing, or storage of other items.

Additional aspects of the invention, together with the advantages and novel features appurtenant thereto, will be set forth in part in the description that follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

FIG. 1 is a perspective view of the preferred embodiment of the retractable step attached to a boat and in a stored position.

FIG. 2 is a perspective view of the preferred embodiment of the retractable step in a stored position.

FIG. 5 is a perspective view of the underside of the preferred embodiment of the retractable step when it is not attached to a boat.

FIG. 6 is an alternative embodiment of the retractable step attached to a boat and in the deployed position.

DETAILED DESCRIPTION OF PREFERRED EMBODIMENT

Figure 3:
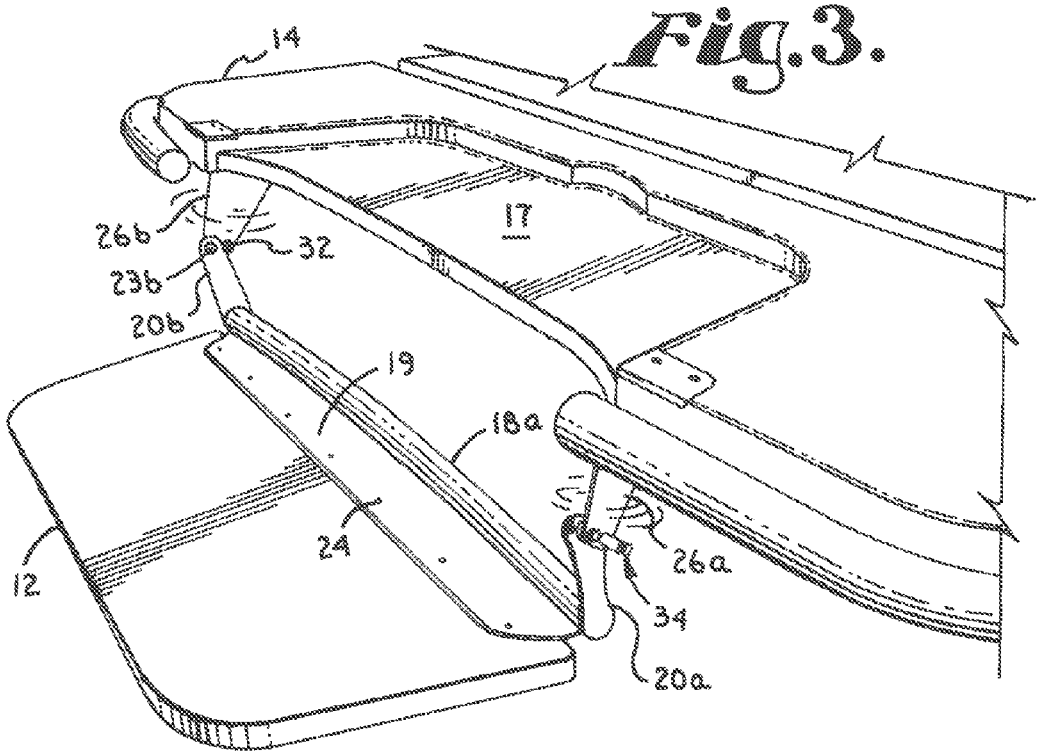
FIG. 3 is a perspective view of the preferred embodiment of the retractable step in a deployed position.

With reference to FIG. 1, the retractable step for a boat swim platform 10 is shown mounted on boat 16 in its stored position. In this embodiment, the retractable step comprises step 12 and base 14. Step 12 is constructed of a material characterized in that its density is less than the density of water. A preferred material for step 12 is closed cell foam having a laminate, waterproof shell. Step 12 is generally rectangular in shape and has a length less than the length of the transom of boat 16 and a width sufficient to provide a large, stable platform when in use.

With reference to FIG. 2, step 12 is stored within base 14. Base 14 is constructed of any sturdy, durable material typically used in the construction of boat swim platforms such as fiberglass. In this embodiment, base 14 is coupled to boat 16. Base 14 is generally rectangular in shape and has a length at least the length of step 12 and a width sufficient to provide space for users to sit or stand. Base 14 also includes recess 17 (shown in FIG. 3) in which step 12 may rest when in the stored position.

Also as shown in FIG. 2, rail 18 is provided around the exposed perimeter of base 14. Rail 18 is constructed of stainless steel tubing. Rail portion 18*a* is provided on the side of step 12 that is exposed when in the stored position such that rail 18 and rail portion 18*a* run in a substantially continuous fashion around base 14 and step 12. A flange 19 is welded to rail portion 18*a* to mount step 12. Together rail 18 and rail portion 18*a* protect step 12 and base 14 and may be used by swimmers for support while in the water.

With reference to FIG. 3, step 12 is shown in its deployed position. In this embodiment, step 12 includes moveable arms 20*a* and 20*b*. Moveable arms 20*a* and 20*b* are made of metal. Moveable arm 20*a* includes apertures 22*a*, 22*h*, and 22*c* (see FIG. 4) in one end. Moveable arm 20*b* includes an aperture (not shown) for receiving bolt 23*b* in one end. Rail portion 18*a* runs between moveable arms 20*a* and 20*b* and is coupled with moveable arms 20*a* and 20*b* on each end. This coupling is accomplished by welding. As shown in FIG. 3, step 12 is coupled with rail portion 18*a* using elongated flange 19. Step 12 is coupled to flange 19 using rivets 24.

Moveable arms 20*a* and 20*h* are each pivotally coupled with metal stationary arms 26*a* and 26*b*, which in turn are coupled with base 14. Stationary arm 26*a* includes coupling aperture 28*a* and lock aperture 27 on one end and arm bracket 30*a* (shown in FIG. 5) on the other end. Stationary arm 26*b* includes stop 32 and an aperture (not shown) for receiving bolt 23*b* on one end and arm bracket 30*b* (shown in FIG. 5) on the other end. Arm brackets 30*a* and 30*b* are secured to base 14 by screws. Also as shown in FIG. 3, lock 34 is on stationary arm 26*a*. The details of lock 34 are depicted in FIG. 4 and described below.

Figure 4:
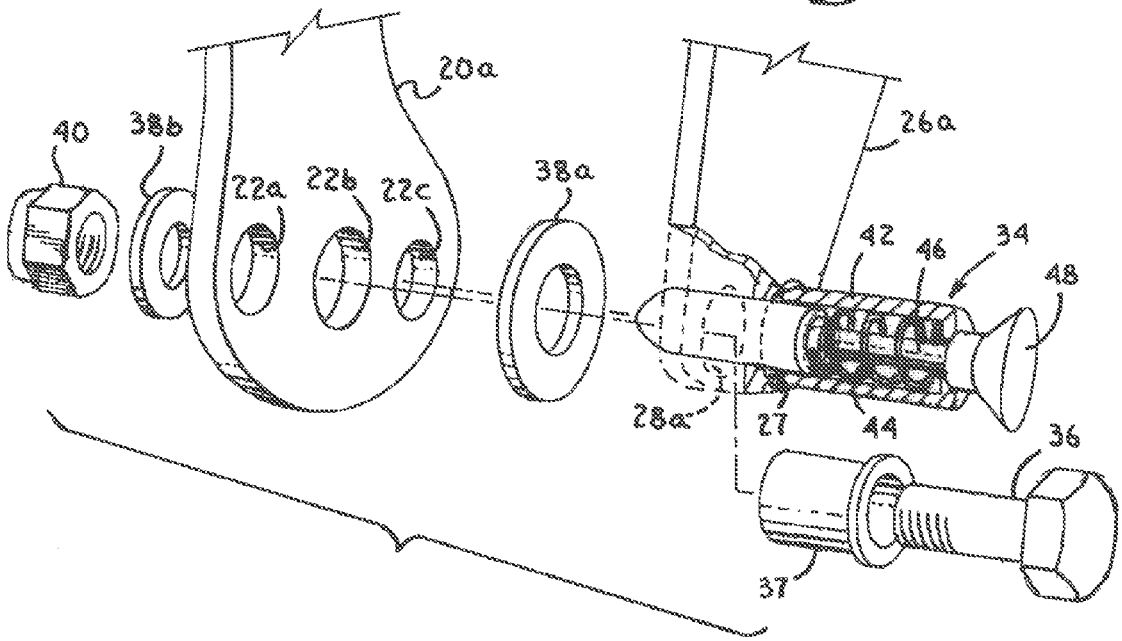
FIG. 4 is an exploded view of the stationary arm and moveable arm coupling in the preferred embodiment of the retractable step and a sectional view of the locking mechanism used with the preferred embodiment of the retractable step.

With reference to FIG. 4, the pivotal coupling between stationary arm 26*a* and moveable arm 20*a* is shown in further detail. Stationary arm coupling aperture 28*a* aligns with moveable arm aperture 22*b*. Bolt 36, bushing 37, washers 38*a* and 38*b*, and nut 40 are used to pivotally couple moveable arm 20*a* and stationary arm 26*a* at aligned apertures 28*a* and 22*b*. Arms 20*b* and 26*b* are pivotally coupled in a similar manner using bolt 23*b*.

Turning now to lock 34, a biased, sliding pin mechanism is shown in FIG. 4. Lock 34 comprises hollow sleeve 42 anchored to stationary arm 26*a* around lock aperture 27. Sleeve 42 houses spring 44 and pin 46. Spring 44 biases pin 46 in the locking position, i.e., extending out of the end of sleeve 42. Pin head 48 at one end of pin 46 is of a size and shape that will allow a user to easily pull pin 46 into its unlocked position, i.e., within sleeve 42.

With reference to FIG. 5, the undersides of base 14 and step 12 are shown when retractable step 10 is not mounted to a boat. In this embodiment base 14 includes a pair of base brackets 50*a* and 50*b*. These base brackets extend beyond the perimeter of base 14 so as to allow a user to demountably couple base 14 with boat 16. Base brackets 50*a* and 50*b* are fastened to boat 16 with appropriate screws.

Variations on the preferred embodiment of retractable step 10 may include some or all of the following features. Some or all of the surfaces of step 12 may include a non-slip material. The exposed surface of base 14 may also include a non-slip material. Although rectangular shapes have been described for step 12 and base 14, step 12 and base 14 may be any shape including but not limited to circular, semi-circular, triangular, substantially polygonal, or any combination of these shapes. Additionally, other types of compartments for storing step 12, such as a shelf, a two-sided structure, or a three-sided structure, may be provided on or below base 14 instead of or in conjunction with recess 17. Finally, other types of locks, including a common cotter pin, a fastening eye bolt, or a trap-door automatic catch lock may be used.

In use, step 12 is capable of being moved between a stored position as shown in FIG. 2 and a deployed position as shown in FIG. 3. In the stored position, step 12 is within recess 17 and moveable arm aperture 22*c* is aligned with lock aperture 27 of stationary arm 26*a*. Step 12 is locked into this position by releasing pin 46 such that it engages apertures 27 and 22*c*. When locked in this position, the underside of step 12 is flush with the top surface of base 14, thus restoring full functionality to base 14 as a platform with a level surface that may be used for standing, sitting, or storage.

To move step 12 from the stored position to the deployed position, pin head 48 is used to recess pin 46 into sleeve 42 whereby pin 46 no longer engages moveable arm aperture 22*c*. While pin 46 is in this position, step 12 may be rotated about bolt 36 and into the deployed position below the water surface. When in the fully deployed position, moveable arm aperture 22*a* aligns with lock aperture 27. When pin 46 is released, it engages both apertures 27 and 22*a*. Spring 44 biases pin 46 in this position, thereby locking moveable arm 20*a* in place. Moveable arm 20*b* is prevented from further movement in the direction of deployment by stop 32. When in the deployed position, step 12 provides a seat on which swimmers may rest while partially submerged in the water or a step for swimmers to use as they transition into or out of the water.

An alternative embodiment of the present invention is shown in FIG. 6 and is generally designated with the number 100. Here, retractable step 100 comprises base 114, which is integral with boat 116 such that base brackets 50*a* and 50*b* (shown in FIG. 5) are not necessary. In this embodiment, base 114 is not removable from boat 116. The components and operation of retractable step 100 is the same as those described above with regard to retractable step 10.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

The invention claimed is:

1. A retractable step for use with a boat in water comprising:

a base having a recess;

a pair of stationary arms, each of said arms coupled with said base;

a pair of moveable arms, each of said moveable arms coupled with one of said stationary arms;

a step having a top side and an underside, said step coupled with said moveable arms and capable of being rotated 180° between a stored position within said recess, wherein said underside is exposed, and a deployed position below the water surface, wherein said top side is exposed; and a spring biased locking mechanism configured to hold at least one of said moveable arms in a stationary position when said platform is in said deployed position and releasable to accommodate movement of said platform to said stored position.

2. The retractable step of claim 1, wherein said base is demountably coupled with the boat.

3. The retractable step of claim 1, wherein said base is integral with the boat.

4. The retractable step of claim 1, wherein said step comprises a material characterized in that it is less dense than water.

5. A deployable swim step for use with a boat in water comprising:

a step having a top side and an underside;

means for coupling said step with the boat, said coupling means configured to permit rotation of said step 180° from a stored position above the water surface, wherein said underside is exposed, and a deployed position below the water surface, wherein said top side is exposed; and means for locking said coupling means in a stationary position when said step is in said deployed position, said locking means further configured to accommodate movement of said step to said stored position.

6. A method of deploying a retractable step used with a boat in water, said method comprising:

providing a base having a recess;

providing a step having a top side and an underside, said step moveably coupled with said base and positioned within said recess when in a stored position, wherein said underside is exposed;

providing a spring biased locking mechanism to hold said step in said stored position;

disengaging said locking mechanism;

rotating said step 180° out of said recess and into a deployed position below the water surface, wherein said top side is exposed; and reengaging said locking mechanism to hold said step in said deployed position.

* * * * *